US009803961B2

(12) United States Patent
Averill

(10) Patent No.: US 9,803,961 B2
(45) Date of Patent: Oct. 31, 2017

(54) SIGHTING APPARATUS AND METHOD

(71) Applicant: Keith A. Averill, Reno, NV (US)

(72) Inventor: Keith A. Averill, Reno, NV (US)

( * ) Notice: Subject to any disclaimer, the term of this patent is extended or adjusted under 35 U.S.C. 154(b) by 715 days.

(21) Appl. No.: 14/217,373

(22) Filed: Mar. 17, 2014

(65) Prior Publication Data

US 2014/0315156 A1 Oct. 23, 2014

Related U.S. Application Data

(60) Provisional application No. 61/789,165, filed on Mar. 15, 2013.

(51) Int. Cl.

| | |
|---|---|
| ***G06F 19/00*** | (2011.01) |
| ***F41J 5/10*** | (2006.01) |
| ***F41J 11/00*** | (2009.01) |
| ***F41G 3/08*** | (2006.01) |
| ***F41G 3/14*** | (2006.01) |

(52) U.S. Cl.

CPC *F41J 5/10* (2013.01); *F41G 3/08* (2013.01); *F41G 3/142* (2013.01); *F41J 11/00* (2013.01)

(58) Field of Classification Search

CPC ..... G06G 7/80; G06G 7/32; F41G 3/06; F41J 5/06; G05B 19/00

USPC ..... 235/404, 400, 417

See application file for complete search history.

(56) References Cited

U.S. PATENT DOCUMENTS

2014/0251123 A1* 9/2014 Venema ..... F41G 3/16 89/41.22

* cited by examiner

*Primary Examiner* — Karl D Frech

(74) *Attorney, Agent, or Firm* — John D. Long, Esq.; Long & Chybik

(57) ABSTRACT

A remote camera target observation system and method of use, the system generally comprising one or more remote camera/wireless transmitter units comprising a video camera connected to a first wireless transmitter that can wirelessly transmit video signals from the video camera; one or more weather meter/wireless transmitter units comprising at least of a weather meter to continuously measure environmental conditions, weather meter/wireless transmitter units wirelessly transmitting data signals of measured environmental conditions made by the weather meter; a receiver/base unit that comprises a wireless receiver that connects to a computer, the computer connects to a user interface, the wireless receiver capable of receiving video signals from the one or more remote camera/wireless transmitter units and data signals from one or more weather meter/wireless transmitter units.

20 Claims, 6 Drawing Sheets

SIGHTING APPARATUS AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to a-remote camera systems used by long range firearm shooters to observe firearm targets located at a long distance from the firearm shooter. More specifically, the present invention may be related to such remote camera observation systems wherein the camera is proximate to the target and relays a visual image of the target to a user interface proximate to the firearm shooter allowing the shooter at a minimum to observe the results of the firearm shooting upon the observed target.

BACKGROUND

Long range firearm shooting may require the shooter, in order to be successful in this art, to generally take into account a wide variety of variable inputs (e.g., ammunition type, firearm specifics, target distance, field conditions, and the like) and substantially integrate them into a final firing solution using known formulae via tables, calculators and the like. This final firing solution is then dialed into an adjustable scope mounted to the firearm to make sighting adjustments in the form of lift (up-and-down adjustments) and windage (side-to-side adjustments).

To find out if the shooter has correctly "dialed in" the final firing solution, the shooter substantially has to see where (or if) the shooter has hit the remote target and where on the remote target did the bullets hit. Due to the distance to the remote target, the shooter generally can't see unaided where the shots have hit a target from the shooting position. Without visual/optical aids, the shooter then generally has to walk or ride to and from the remote target (whose placement can be measured in hundreds to thousands of yards/meters from where the shooter fired) to inspect the remote target for bullet hole (i.e., shot) placement.

Alternatively, the shooters may use telescopes called spotting scopes to avoid actually traveling to the remote target to see how well they have done. These spotting scopes, which are to generally very high power (and accordingly can be very expensive) are placed on a stand proximate to the shooter so after the shooter has fired a shot or shots, the shooter views the target through the spotting scope. In those circumstance, the shooter generally has to stop shooting entirely; move out of and leave her firing stance and then go over and look through the spotting scope. Alternately, the shooter could have a spotting partner at the nearby spotting scope watching the target as the shooter takes the shot(s) and then the spotting partner tells the shooter about the results of such shooting.

What many long range shooters may find is that even after putting significant investment in the top-of-the-line spotting scopes, they still are not able to see where their shots have hit the remote target. When the distance to the remote target gets to be 500 yards/meters or more, the magnification of even the high quality spotting scope is generally not enough to allow the observer to view and see the placement of the shots (e.g., small diameter bullet holes) upon the remote target. In hot weather, this problem is exacerbated due to the mirage (e.g., heat waves in the air) that can further blur the visual picture of the remote target. The movement of the sun during the day can also impair the target viewing. When the sun is lower in the afternoon sky, the sunlight can hit and reflect off of the area behind the target just right so that the reflected color of that area matches up with the color of the target to make holes in the target literally seem to disappear.

As a result, when long range shooters are shooting 500 yards/meter or more, they once again are forced to travel (e.g., walk or drive) to and from the remote target to see their shooting results. This travel time (which increases with target distance) can significantly cut down on the time used for shooting and as well as being a significant and continual disruption of the shooting activity. This disruption can possible interfere with the shooter's setup and concentration needed to effect good results with long range shooting (e.g., getting out of/into the shooter's concentration "bubble"; moving out/into of a shooting position; disengaging from/wrapping into the rifle sling; unbuttoning-releasing/getting into/fastening up a specialized shooting coat-if used; placing down/picking up the firearm; making safe/loading the firearm; and moving from/into the selected shooting location, etc.).

In an attempt to move away from these shooting distractions, shooters have started to substantially use remote camera target surveillance systems. These systems may use a self-powered camera that is placed proximate but not too proximate (to reduce the likelihood of shooter shooting the camera by mistake) to the remote target. The remote camera may then utilize a transmitter to wirelessly communicate to a wireless receiver connected to visual display device (e.g. a laptop computer or like) located proximate to the shooter to present the visual image of the remote target as captured by the remote camera. Not only does such remote camera target surveillance eliminate the need and time to go visit the target but may also substantially eliminate mirage and low sunlight visual interference issues. Further, the shooter now can stay in place and "fully suited up" in the fully-rigged up shooting position. The shooter merely shifts her glance over to the laptop screen that is conveniently placed next to her shooting location to see a very clear picture of the target and of any resulting bullet holes. She then shifts her glance back to aiming the firearm to make any corrections to the firearm aiming system to generally try to improve bullet placement upon the target. In this manner, the shooter can maintain her shooting concentration and have more time (that was formerly used for spotting) to apply to the actual shooting activity.

One possible limitation for such remote camera target observation systems could be that such systems are limited to providing only a visual target observation and ignore other critical shooting effects/factors that traditionally can be used to improve the results of long range shooting activity. One such category of critical effect/factors is the meteorological, atmospheric or environmental conditions in the area (e.g., shooting range, field, etc.) where the shooting activity is taking place. One such atmospheric condition is the effect of wind on the bullet's pathway to the target. Wind can actually deflect a bullet from its expected trajectory path, generally sideways, in an effect known as windage. When the wind is moving perpendicularly to the bullet's trajectory, the bullet deflection is greater. When the wind is moving towards being parallel to the bullet's pathway, less bullet deflection occurs. Other atmospheric conditions have an effect on a predicted bullet trajectory as well such as altitude, barometric pressure, pressure trend, crosswind, density altitude, dew point, headwind/tailwind, temperature, and the like.

Although the written windage tables and like can generally be used to correct for some wind conditions, shooters use their experience and personal sense of the weather conditions to try to guestimate the windage correction in a manner traditionally known in the long range firearm shooting field as "Kentucky Windage." The problem with this Kentucky Windage guestimate is that the atmospheric conditions at the area where the shooting is taking place generally do not match the environmental (e.g., atmospheric/meteorological/weather) conditions all the way out to the remote target or at the remote target itself. The further the target is from the shooter, the more likely the differences between the atmospheric conditions between the target's location and the shooter's location will be significant.

In addition to not being able to meter atmospheric conditions, current remote camera target observation systems may further lack other shooting impact capacities like ballistic calculations (e.g., taking into account such factors of ammunition type, bullet shape, weight and projected speed, range-to-target and the alike that can also affect projected bullet trajectory); memory capacity to retain and transfer measured and processed data results (e.g., data memory cards and the like); the capacity to provide user-based manipulation of gathered and stored data and the like.

Other possible limitations of existing remote camera target observation systems could be that they may be piecemeal-based solutions, providing less than all of the total needed components for a successful remote camera target observation system and generally are not otherwise fully self-contained. As a result, the existing remote camera target observation systems could be seen as being bulky and difficult to transport in the field.

One possible solution to such issues could be the present invention, a remote camera target observation system for long range shooting that further incorporates a capability of measuring the atmospheric conditions of the shooting range/field/area and present such measurements on a visual interface in a manner that can be easily and visually grasped by the shooter along with a visual image of the target. One such embodiment of the present invention could comprise one or more remote camera/wireless transmitting units and one or more (remote) weather meter/wireless transmitting units that respectively wirelessly communicate target image and atmospheric data (and the like) to a receiver/base unit proximate to the shooter. Each of the remote camera/wireless transmitter units and weather meter/wireless transmitter units could have their own power source and a transmitter that can wirelessly connect to the base/receiver unit. The base/receiver unit (generally placed proximate to the shooter) could have a receiver to receive the wireless signals as sent from the remote camera wireless transmitter units and the weather meter/wireless transmitter units and send such signals onto the receiver/base unit's computer. The computer could process such data and visual signals and then use a user interface to display data (processed and otherwise) along with a visual image of the target.

The remote camera/wireless transmitter unit, weather meter/wireless transmitter unit and the receiver/base unit can be battery-powered making them useful anywhere and also in other applications besides long range shooting. The receiver/base unit could comprise individual power units and a wireless receiver that can be connected to a user interface having visual to display. The combination of remote live video capability and remote weather monitoring capability being fed into one receiving/base unit is one unique aspect of the present system. The present invention's ability to provide quality components of small size that can be contained in a kit for easy transport is another unique aspect. The quality of the overall combination of the components of the present system is yet another unique aspect.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to see shots placed on a remote, long range, even an ultra-long range (e.g., 1500-2500 yards/meters) shooting target, the shots being clearly shown on a display screen proximate to the shooter;

provide a target observation system that allows a shooter to see the bullet holes on a very remote target without the shooter having to move out of her shooting position;

the ability to increase the ease and the precision of sighting in long range rifles and associated optic sighting equipment;

provide a target observation system that reduces mirage and dust effect on target observation;

the ability to allow a number of people to clearly view the effects of shooting at a remote shooting target at any one time;

the ability to improve the instruction capability of a shooting instructor to a respective student long range shooter;

provide a target observation system that uses multiple receiver/base units and video screens so that a target can be viewed from various locations by people other than the firearm shooter to increase the accuracy and ease by which shooting competitions could be run and scored;

the ability to generally use multiple remote cameras trained on multiple remote targets allowing the observer to view more than one remote target by simply changing the channel on the receiver/base unit;

providing one or more remote weather meter/transmitter units that can be used to obtain and transmit weather conditions of various areas of a shooting range/field, including but not necessarily limited to an area where the shooter is located, to provide the shooter with a better comprehension of environmental (e.g., meteorological/atmospheric/weather) conditions taking place on the field or shooting range where shooting activity is taking place;

providing one or more weather meter/transmitter units that can be placed in the field or shooting range relative to the bullet's expected general flight path so that the shooter can use multiple weather measurements of the field/shooting range in calculating the projected bullet trajectory to the target and making suitable adjustment to the firearm's aiming systems; and to [35] the ability to simultaneously input meteorological/atmospheric data from multiple sources located in a field/shooting range into a ballistics calculator for predicting a bullet's trajectory to allow for adjustments in a firearm's sighting optics to correct the calculated bullet trajectory for desired bullet placement upon a target.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a remote camera target observation system comprising one or more remote camera/wireless transmitter units comprising a video camera connected to a first wireless transmitter that can wirelessly transmit video signals from the video camera; one or more weather meter/wireless transmitter units comprising at least of a weather meter to continuously measure environmental conditions, the one or more weather meter/wireless transmitter units wirelessly transmitting data signals of measured environmental conditions made by the weather meter; a receiver/base unit that comprises a wireless receiver that connects to a computer, the computer connects to a user interface, the wireless receiver capable of receiving video signals from the one or more remote camera/wireless transmitter units and data signals from one or more weather meter/wireless transmitter units; wherein the one or more camera/wireless transmitter units transmits the video signals of an object located outdoors and remote from the receiver/base unit, the video signals are presented upon the user interface; the one or more weather meter/wireless transmitter units transmits environmental condition data signals for the environmental conditions in an area where the object and the receiver/base unit are both present, the computer processes the data signals along with other data to present a firing solution used to shoot the object.

One possible embodiment of the invention could be a process or method of operating a remote camera target observation system comprising the following steps, a remote camera target observation system comprising of one or more remote camera/wireless transmitter units for wireless transmission of video pictures of an object remote from a shooter, one or more one or more weather meter/wireless transmitter units set up in area between the shooter and the object, a receiver/base unit that is located proximate to the shooter and receives wireless signals from both the remote camera/transmitter units and the weather meter/wireless transmitter units, the receiver/base unit further processes the received signals and presents the processed received signals through a user interface; processing the environmental data collected and transmitted by weather meter/wireless transmitter units along with other data into a firing solution used to shoot the target; and presenting a visual image of the target.

One possible embodiment of the invention could be a combination of a remote camera target observation system and a firearm, the remote camera target observation system comprising one or more camera/wireless transmitter units comprising a video camera connected to a first wireless transmitter that can wirelessly transmits video signals from the video camera; one or more weather meter/wireless transmitter units comprising at least of one weather meter that wirelessly transmits data signals on environmental conditions as measured by a weather meter; a receiver/base unit that comprises a wireless receiver connected to a computer that is further connected to a user interface with a visual display, the wireless receiver capable of receiving video signals from the one or more camera/wireless transmitter units and data signals from one or more weather meter/wireless transmitter units; a firearm having a aiming system, wherein the one or more camera/wireless transmitter units transmits a video signal of an object that is located outdoors and is remote from the firearm, the video signal is presented upon the visual display; the one or more weather meter/wireless transmitter units transmits environmental condition data signals for the environmental conditions in an area where the object and the receiver base are both present, the computer processes the data signals along with other data to present a firing solution through the user interface that is then used to adjust an aiming system of a firearm.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
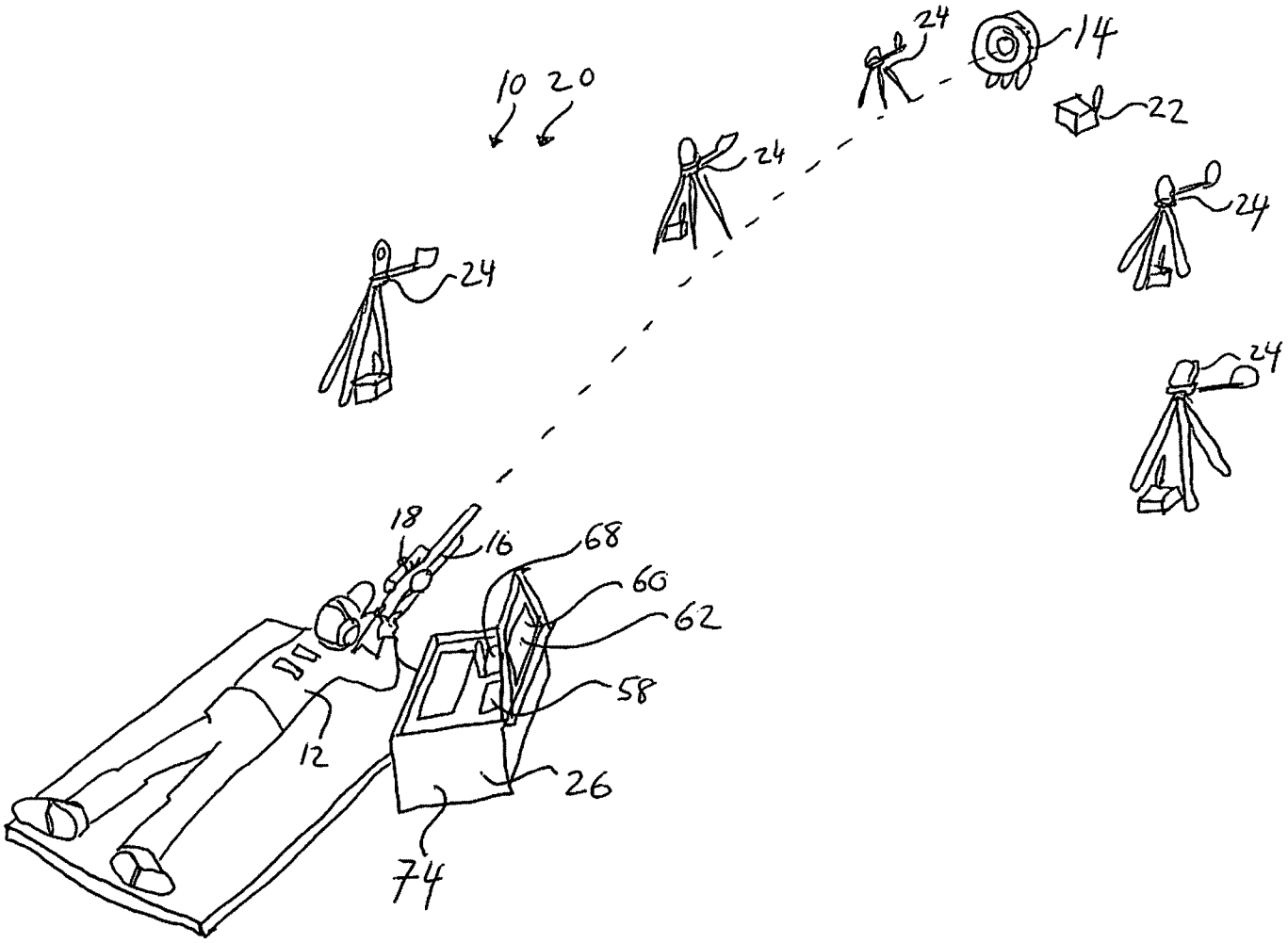
FIG. 1 is substantially a perspective view of one embodiment of the present invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention 10 comprises a remote target observation system 20 and a method for operating same 100. As substantially shown in FIG. 1, the remote camera observation system 20 for long range target shooting could comprise of one or more remote camera/wireless transmitter units 22 and one or more weather meter/wireless transmitter units 24 that can wirelessly communicate to a receiver/base unit 26. The receiver/base unit 26 could wirelessly receive (e.g., via wireless receiver 68), store and process video signals from the remote camera/wireless transmitter unit(s) 22 and the data signals from weather meter/transmitter unit(s) 24 through a computer 58 (e.g., a CPU-Central Processing Unit with at least some form of memory storage). The computer 58 could connect to a user interface 60 (e.g., having a visual display 62) to present to the shooter 12 an image of the target 14; data concerning environmental conditions (e.g., atmospheric, meteorological and weather factors) generally present in the shooting range/field/area between the target 14 and the shooter 12; and utilizing a ballistic program(s) to create a firing solution to be applied to the aiming system 18 of the firearm 16 (e.g., firing solution information being entered into the firearm optics to place a shot upon the target 14.) In at least one kit embodiment of the invention, the receiver/base unit 26 is incorporated into a portable hinged lid container 74 that can support the receiver/base unit 26 and as well as the hold or contain remote camera/wireless transmitter unit(s) 22, weather meter/wireless transmitter unit(s) 24 or both when the units are not in use.

Figure 2:
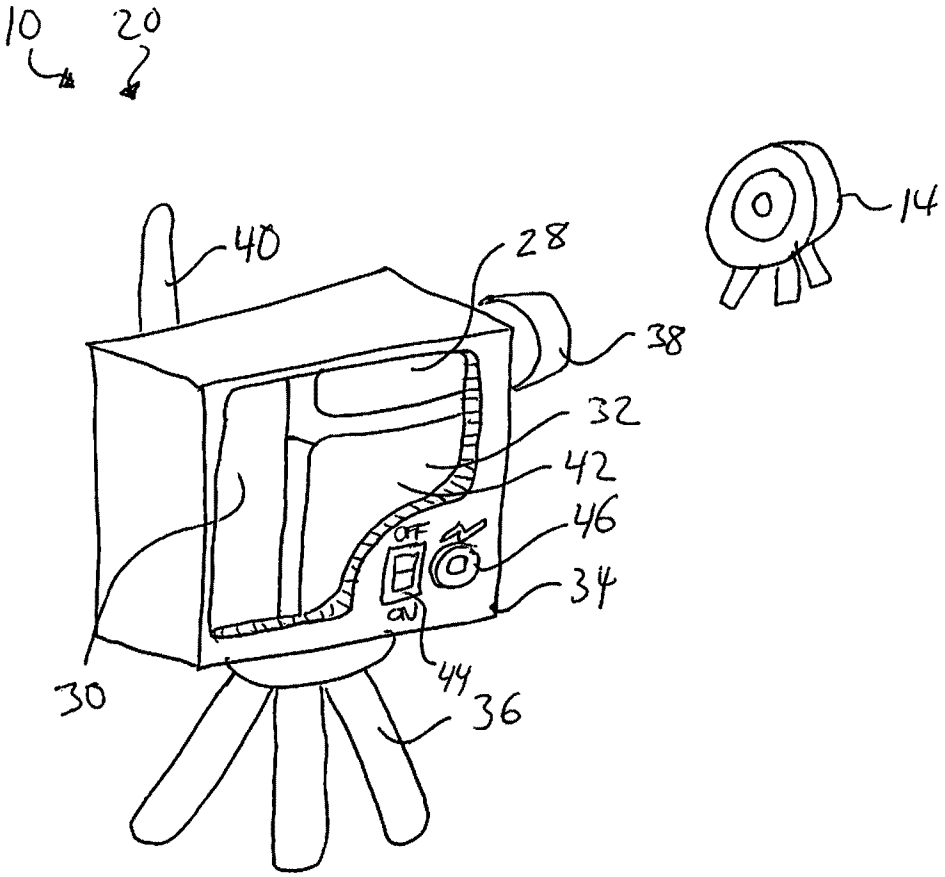
FIG. 2 is substantially a perspective cutaway view of one embodiment of the remote camera/wireless transmitter unit of the present invention.
Figure 3:
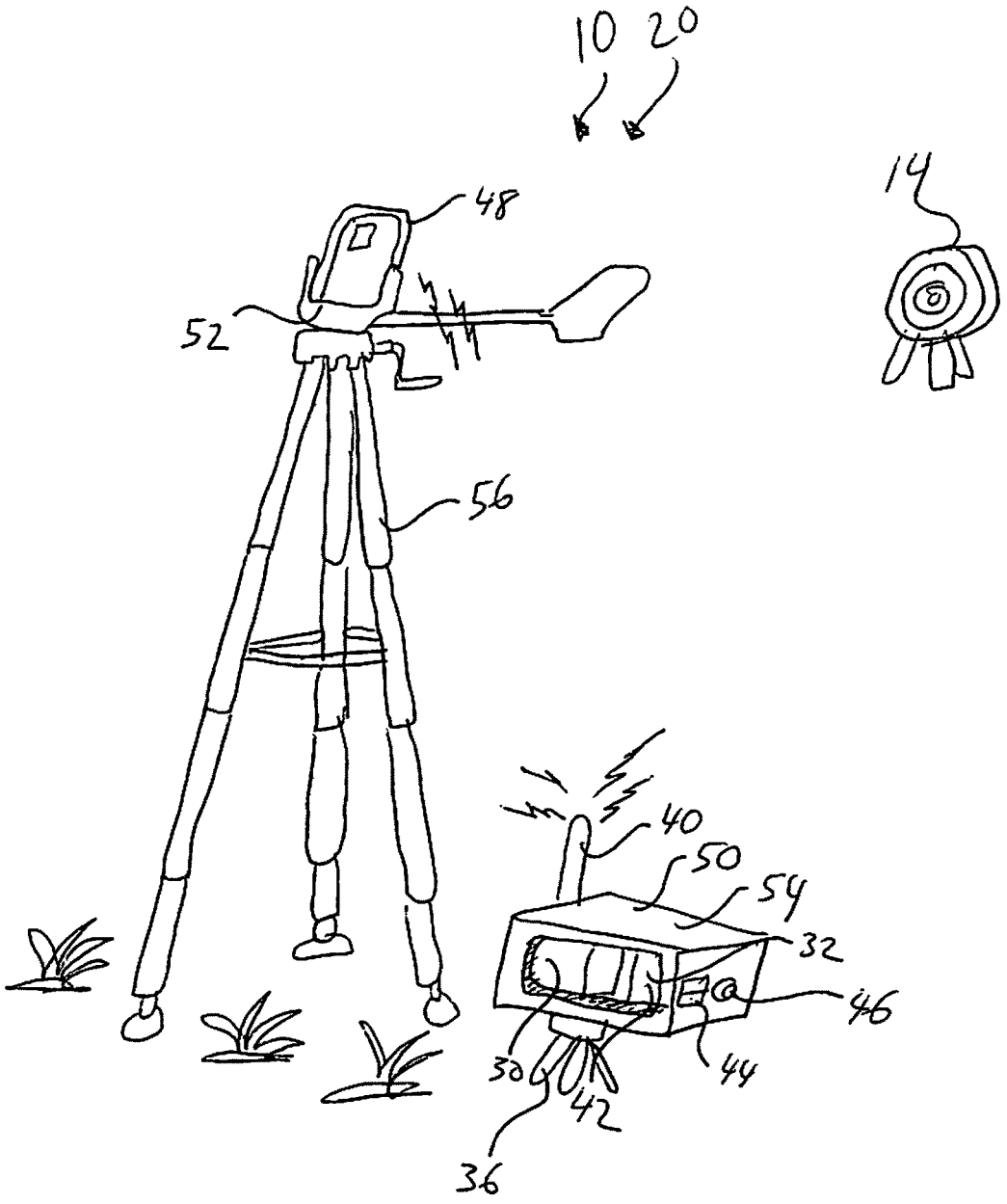
FIG. 3 is substantially a perspective cutaway view of one embodiment of the weather meter/wireless transmitter unit of the present invention.

As shown generally in FIG. 2, the camera/wireless transmitter unit 22 could comprise a bullet video camera 28, a wireless transmitter 30, a power supply 32 generally contained within and supported by a protective camera case 34. In at least one embodiment, the camera/wireless transmitter unit 22 could further comprise of a support tripod 36 to support and position the protective camera case 34 off of the ground. The bullet video camera 28 (substantially named for its shape [e.g. cylindrical] and small size) is video camera type that is commonly used in a surveillance activities and can provide a resolution just as high as their larger brethren despite their small size. To accomplish this, the bullet video camera 28 may use a small inline video to imaging chip rather than the standard board design.

One possible bullet video camera 28 that could be used with the invention 10 could be a model 3035 bullet video camera with 1/3 Sony sensor provided by the Sony Corporation, 550 Madison Avenue, New York, N.Y., USA. The inventor has found that this particular model can generally clearly see a remote target 14 during direct midday sun as well as at dusk in minimal light. This model can further be used with a suitable camera lenses 38 (e.g., 16 mm or 25 mm telephoto lens with standard m12 sized threads to connect the camera lenses 38 to bullet video camera 28) to give the remote camera/wireless transmitter unit 22 a viewing range that is substantially suitable for remote target observation.

The bullet video camera 28 could be connected (e.g., via output video leads—not shown) from the wireless transmitter (e.g., multi-channel) 30 for transmitting the video data (e.g., of the remote target 14) generated by the bullet video camera 28 to the receiver/base unit 26. The transmitting frequencies selected for the wireless transmitter 30 could be based upon the particular application type, location requirements, and transmission distance requirements. Once such possible frequency range could include 900 Mhz, 1.2 GHz, 1.3 Ghz, 2.4 Ghz, 5.8 Ghz bands and the like.) As a very general rule of thumb, the lower bands frequencies (900 Mhz-2.4 Ghtz) may offer a significant advantage in that they can transmit their signals for longer distances with less power. However, these lower frequencies have a larger Fresnel zone and usually require the wireless transmitter 30 (e.g., for remote camera/wireless transmitter unit 22) to be mounted further off the ground (e.g., via a support tripod 36) to transmit properly. Higher frequency bands could be used in that they have smaller Fresnel zones (e.g., those wireless transmitters 30 do not need to be mounted as high off the ground as low frequency wireless transmitters 30). However, higher frequency wireless transmitters 30 require more output/electrical power (e.g., a larger power source) to achieve the equivalent transmission distance given by the lower frequency band wireless transmitters 30. Wireless transmitters 30 could be single or multiple channel types and could be further selected based on whether a particular shooting operation target setup is monitoring one or multiple targets 12 at the same time.

In one possible embodiment of the invention 10, the remote camera/wireless transmitter unit 22 could use a wireless transmitter 30 that is capable of transmitting wireless video signals and operating in the 1.2 GHz-1280 frequency, or 2.4 GHz. A multi-channel transmitter model as made by Shenzeh Partom Technological Development Company, LTD. 5/F, 702 Building, Bagua 3RD, Futian District, Shenzhen Guangdong province 518029, China could be used for this embodiment. Generally, these "Partom" wireless transmitters 30 are sold in a combined transmitter/receiver kit. This category of long range (e.g., up to a mile or so) wireless video transmitters/receivers are substantially used in model airplanes to give a First Person View (FPV) to the operator through video glasses so the operator of the model airplane sees and operates the model as though the operator was a pilot in the model. The long range and high quality video signal transmission of these wireless video transmit/receive units make them very suitable for use in the present invention 10.

The antenna 40 used with the wireless transmitter 30 can be selected depending on the invention's particular target application. The antenna type selected can be omni-directional, directional, yagi, patch, etc., depending on the intended environment, range requirements, interference in the intended usage area, and the like.

The power supply 32 could be a battery or batteries 42, while in other embodiments could utilize other electrical powering means such as solar panels (not shown.) One embodiment of the power supply 32 could comprise the use of a battery 42 that is connected to and energizes the bullet video camera 28 and the wireless transmitter 30 through by an on-off switch 44, the battery 42 being further connected to a standard power charger jack 46 to allow a connection to an independent power charger (not shown) to generally re-energize the battery 42 using current from a household source (e.g., standard electrical [115V] outlet—not shown) or the like. One such battery 42 could be a 12 Volt 2.9 AH (Amp Hour) sealed lead battery such as Model TR2.9-12P from Tempest, 1272 Alma Court San Jose, Calif. 95112.

The protective camera case 34 could be a box-lid type made of die-cast aluminum for lightweight ruggedness, generally having dimensions of seven inches×five inches by three inches that generally houses the bullet video camera 28, wireless transmitter 30, power supply 32. One such protective camera case 34 could be model CN-5707 as made by Bud Industries 4605 East 355th Street, Willoughby, Ohio 44094, USA. The protective camera case 34, once drilled for generally mounting the power charger jack 46, on-off switch 44; antenna mount 40, and lens 38, could be powder coated for weather resistance. The lens 38 would be placed on the outside of the protective camera case 34 to allow for operator manipulation (focusing of the bullet video camera 28 upon the remote target 14.) The wireless transmitter 30, battery 42, and bullet video camera 28 could be held in place with the protective camera case 34 through a variety of means known to those skilled in the art, such as fasteners, adhesive, friction-fit and the like.

The protective camera case 34 could be further supported off the ground by the support tripod 36. The support tripod 36 could extend to sufficient height to hold the remote camera/wireless transmitter unit 22 off the ground (e.g., accommodating the Fresnel effect) and be further used to aim the unit towards the remote target 14 (as substantially shown in FIG. 1.)

As substantially shown in FIG. 2, the weather meter/wireless transmitter unit 24 could comprise of a weather meter 48 and a combination unit 50 of a wireless transmitter unit 30 and power supply 32. The weather meter 48 that could be one selected from the Kestrel® 4000 series weather meters as made by Nielsen-Kellerman, 21 Creek Circle, Boothwyn, Pa. 19061, USA. This is a self-contained, hand-held, battery-powered weather meter 48 can measure and record a variety of environmental conditions. In particular, the 4500 model is also Bluetooth® (e.g., smart radio frequency or RF communications) capable and can communication with other electronic devices also having the same smart radio frequency or RF communication capability up to thirty (30) feet away. This unit's power supply 30 could be same as or constructed very similar to the power supply 30 as used by the remote camera/wireless transmitter unit 22.

The 4500 series weather meter 48 can be further mounted in a Kestrel® Portable Vane Mount 52 also made by Nielsen-Kellerman that can pivot upon a top of a meter tripod 56 (e.g., a camera tripod type that could hold up the weather meter 48 away from any blocking ground impediments) to allow the vane of the pivoting mount in interact with the wind at the shooting range/field/area to keep the weather meter 48 pointed into the wind for more accurate environmental measurements. The weather meter 48 could further communicate with combination unit 50 (e.g., the wireless transmitter 30) through smart wireless communication—the transmitter also being similarly adapted using means known to those skilled in the art to receive/transmit such smart wireless communication signals) or through other means (direct wire/cable communication—not shown.) It should be noted in transmitting data signals (rather than video image signals) that a less powerful transmitter/receiver system could be substituted and used with the weather meter/transmitter unit 24.

The wireless transmitter 30 (e.g., smart radio frequency or RF communications modified/enabled) and power supply 32 could be encased in housing case 58 that is similar in design and construction as the protective camera case 34. The weather meter 48 could transmit collected data on shooting range/field/area's environmental conditions and relay that data to the combination unit 50 placed proximate to the weather meter 48 (e.g., at the base of the meter tripod 56.) The wireless transmitter 30 could then relay that environmental data information onto the receiver/base unit 26 for processing, storage and presentment to the shooter.

Figure 4:
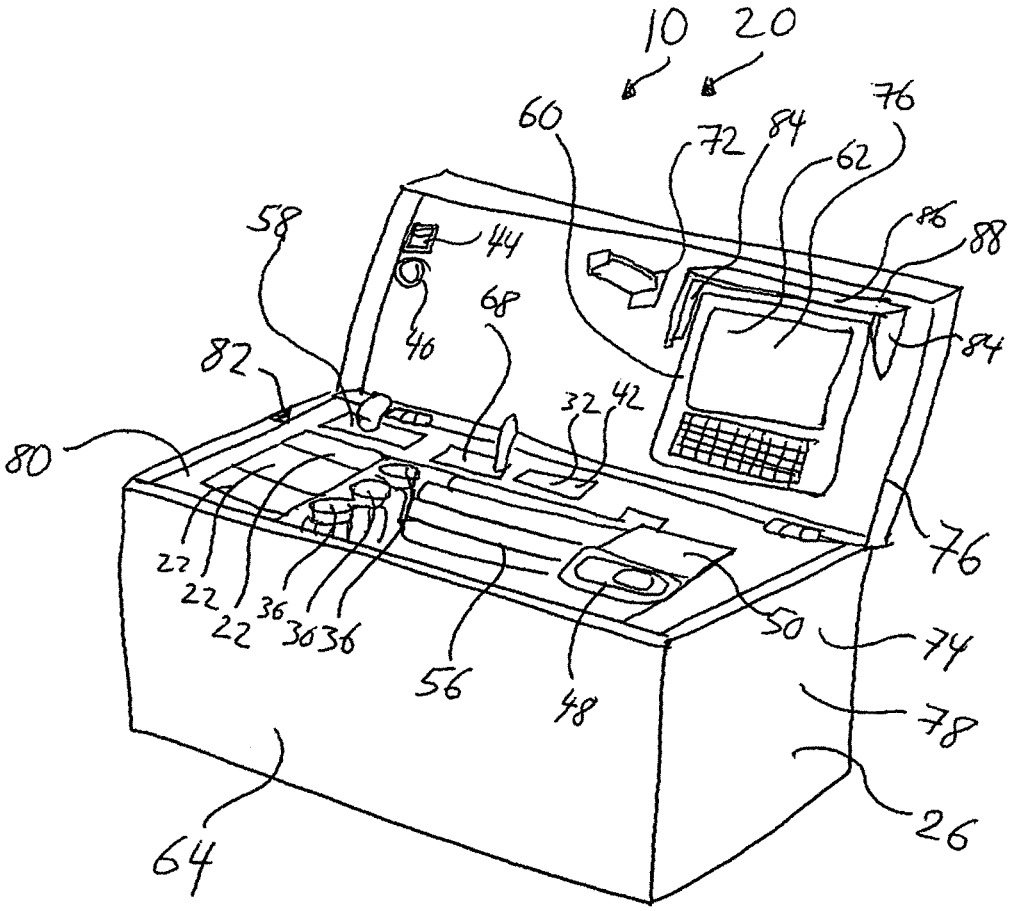
FIG. 4 is substantially a perspective view of one embodiment of the receiver/base unit of the present invention.

As substantially shown in FIG. 4, the receiver/base unit 26 could comprise a wireless receiver 68, a computer 58, a user interface 60 (e.g., with visual display 62), and a power supply 32 all housed in and supported by a base unit case 64. The wireless receiver 68 could be a model as made by Shenzeh Partom Technological Development Company, LTD. 5/F, 702 Building, Bagua 3RD, Futian District, Shenzhen Guangdong province 518029, China as part of the kit supplying the wireless transmitters 30 for the remote camera/wireless transmitter unit 22/weather meter/wireless transmitter unit 24. An antenna 40 attached to the wireless receiver 68 could be selected on the intended shooting application (e.g., omni-directional, directional, yagi, patch, etc.)

The wireless receiver 68 could be multi-channel (as are these type of "Partum" wireless receivers) that can be switched between the channels by the operator/shooter or modified to be switched by the computer 58. If wireless receiver 68 is computer-controlled, the computer 58 can be further programmed to switch receiving the respective channels for various remote camera/wireless transmitter units 22 and weather meter/wireless transmitter units 24 (as generally shown in FIG. 1). In such a manner, the invention 10, in a timed and sequenced manner, could switch channels to take in various data from several weather meter/wireless transmitter units 24. The timed and sequenced manner for this channel switching could be based on the operator (e.g. shooter) inputting into the computer 58 assigned "weightings" or values to one or more weather meter/wireless transmitter units 24. The "weighting" or value assignment can be based on environmental (e.g., wind) conditions in some weather meter/wireless transmitter unit locations having a greater impact than other weather meter/wireless transmitter unit locations located along or proximate to the bullet's trajectory/flight path. For example, those weather meter/wireless transmitter units 24 closest to the shooter 12, firearm 16 or both (as substantially shown in FIG. 1) (where the wind has the most windage effect on the bullet trajectory and pathway) would be given the greatest "weight" (e.g., be given the most data collection time; have the most data inputted and processed by the computer 58 or both.) For those weather meter/wireless transmitter units 24 having a greater distance from the shooter 12/firearm 16 (e.g., are closer to the remote target), those weather meter/wireless transmitter units 24 are accorded progressive lower value weightings. It should be noted that many shooters believe in just the opposite wind effect theory, that wind values nearer the target, not the shooter, should be given the most accordance. The accumulated and processed data from the "weighted" weather meter/wireless transmitter units 24 could accordingly be given a proportional influence/effect on the calculation of the firing solution in proportion to their assigned "weight" values. The operator/shooter 12 could alternatively override the weighting input entirely through the user interface 66.

In some embodiments, the invention 10 could have the ability to display various environmental data/processed information on the visual display 62 numerically, graphically or the like; averaged over selected time periods; or in raw data form. This data/processed information presentation on the visual display 62 of the user interface 60 could be interspersed with video feeds of the remote target 14, or the shooter/operator 12 could program the computer 58 to wait for the operator/shooter input into the computer 58 to present the video feed. For example, the shooter would first use the environmental data feed/firing solution presentation to dial in the firearm's aiming system 18 (as substantially shown in FIG. 1); time the taking of the shot; take the shot and then notify the computer 58 to show the video feed.

Alternatively, the computer 58 could be programmed to superimpose environmental data/information (e.g., processed data) presentation over the remote target live video feed on the visual display 62. This invention version could generally require two (2) wireless receivers 68 (e.g., one for atmospheric data signal feed and one for video signal) that are integrated with the computer 64 and its programming.

The computer 58 could be one selected as by one having ordinary skill in the art to receive, process, and record data coming from weather meter/wireless transmitter unit(s) 24 as well as receive, record and present a video image being sent from remote camera/wireless transmitter units 22. The computer 58 can have an integrated ballistics calculator program to further process the incoming atmospheric data into usable information. This type of program can take live feed meteorological data along with additionally previously inputted shooter variables such as bullet type, bullet ballistic coefficient, bullet drop, muzzle velocity, distance-to-target, angle-to-target and the like to set for a firing solution for the present shooting situation. The firing solution can then be used by the shooter 12 to make adjustments on her rifle's optics/aiming system 18 to try and wring out the most shooting accuracy for that particular shooting situation.

Figure 5:
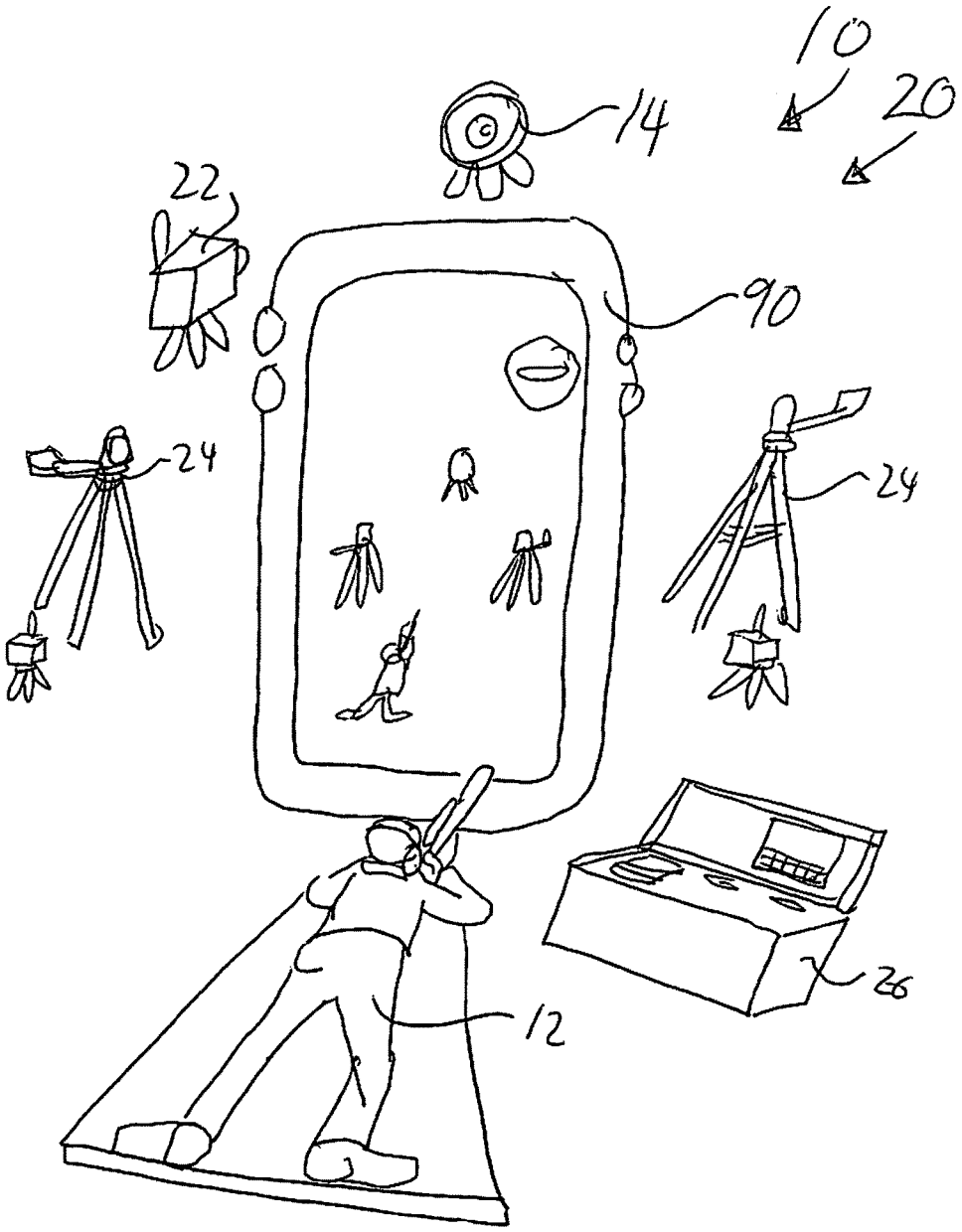
FIG. 5 is substantially a perspective view of GPS unit in relation to the real objects that GPS Unit is displaying on the GPS Unit's visual display screen.

As substantially shown in FIG. 5, at least one embodiment of the invention could further comprise a GPS (i.e., Global Position System) capability 90 (e.g., integral unit or independent hand-held GPS unit) that could be used to determine the location of the shooter 12/firearm 16; the remote target(s) 14; and the weather meter/wireless transmitter unit(s) 24. That location data could then be input into the computer 58 for processing and the like. The computer 58 could be further programmed to analyze the environmental data feed from the weather meters 48 along these known location coordinates to create a real time environmental map of the shooting range/field/area. This map could be visually presented as a graphic to the shooter to be used to time the shot (e.g., holding a shot until a burst of wind has passed by the bullet projected pathway) and the like.

The user interface 60 could additionally feature a user input device such as touch pad 70 or key board to allow the shooter/operator 12 to input data directly into the computer. In other embodiments, the user interface 60 could embody both visual display 62 and user input device combined such as a touch screen (not shown.)

The visual display 62 in one possible embodiment could be a widescreen full color seven inch viewing area TFT/LCD "active matrix monitor" capable of 720 resolution in either 4/3 or 16/9 aspect ratio such as model # PLHR76 as supplied by Plye Audio, Inc., 63$^{rd}$ Street, Brooklyn N.Y. 11204 USA. This monitor is designed for automotive DVD applications so it can work in bright sunlight or dark of night and withstand temperature extremes typical of vehicle interiors which closes matches the outdoors operation environment for the present invention 10.

In at least one embodiment, the computer 58 could be accessed through a secondary input device (i.e. memory card, key fob . . . ) to transfer data & input into the receiver/base unit 26. This capability could enable the shooter 12/operator take information (e.g., logarithms, shooting data, etc.) from a library of ballistic calculations from a variety of sources (e.g., ammunition web sites, bullet manufacturers . . . ) and have the computer 58 integrate the collected information into its processing.

The inputs into these ballistic algorithms could come from different sources. These sources can be found in databases online as well as vendors who have compiled them. The computer/user interface could have the ability to receive this input via an input device (memory card) and then use it along with environmental data. The computer 58 could be adapted also interface with various other devices, such as a mobile unit or device, iPad, etc. to either obtain ballistics calculations, or in some instances, transmit the recorded weather information to the mobile unit to then enable calculation and/or display of the ballistics calculations on the mobile unit itself.

The receiver/base unit 26 could use the same or similar power supply 32 as the remote camera/wireless transmitter unit 22 and the weather meter/wireless transmitter unit 24, a 12 Volt 2.9 AH (Amp Hour) sealed lead battery connected to the other electronic components through an on/off switch 44. A power charger jack 46 attached to the battery 42 could allow suitable recharging of the battery 42 as needed.

The receiver/base unit 26 could be housed in a hinged lid container 74 such as model Pelican Storm iM2100 with custom foam insert in the bottom. This container 74 could in one embodiment measures 14.2"×11.4"×6.5" and weighs 4.2 lbs. The visual display 62 can be mounted into the inside of the lid 76 of the hinged lid container 74 with a custom-manufactured mounting plate that is manufactured through CNC laser cutting of acrylic sheets. Similarly, the user interface 60 could be placed in the lid 76 as well. The wireless receiver(s) 68 could be placed in the main box portion and affixed to the box's walls 78. The battery 42 and computer 58 could be affixed to the hinged lid container 74 in the same manner. These components could surround a foam core center 80 wherein cutouts 82 are made to accommodate and otherwise house the remote camera/wireless transmitting unit 22 and the weather meter/wireless transmitter units 24.

Additionally two acrylic side plates 84 and top acyclic plate 86 can be assembled to form a removable sun visor 88 that attaches to the lid 76 proximate to the visual display 62 to reduce sun glare on the visual display 62 when in operation.

Figure 6:
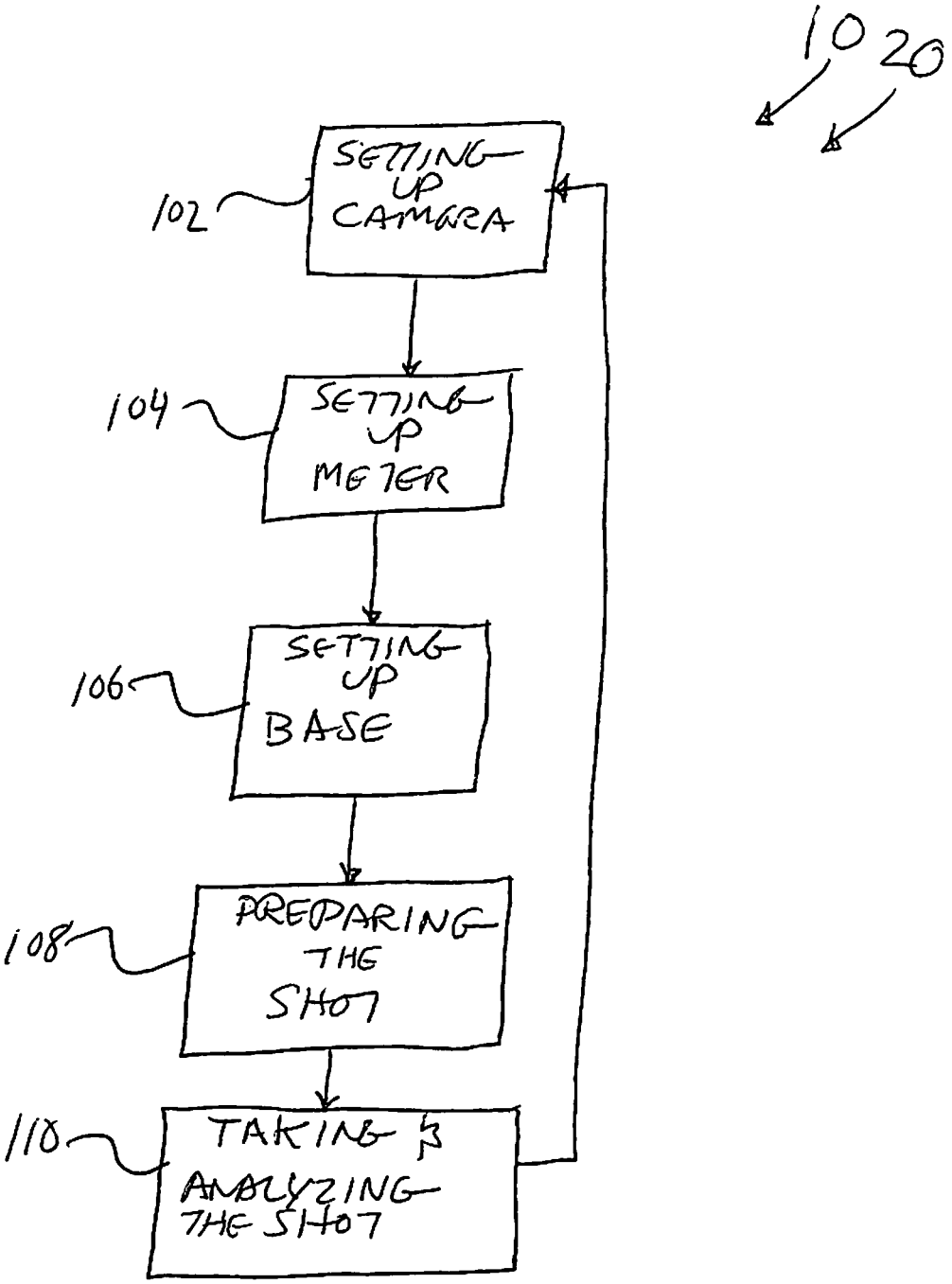
FIG. 6 is substantially a flowchart schematic showing one possible embodiment of a process or method for operating the present invention.

As substantially shown in FIG. 6, one possible process or method for operating the invention 100 could start with step 102, setting up target video, which could involve taking the invention generally out to where the remote target is located and then remove the remote camera/transmitter unit from the case. The remote camera/transmitter unit could be placed at safe distance away from the remote target (approximately 25' feet) in an offset orientation from the line of sight between the remote target and the shooter's position (e.g., to lessen the chance of a shooter accidentally shooting remote camera/wireless transmitter unit.) The remote camera/wireless transmitter unit can be further mounted on a standard camera tripod if desired to be otherwise aimed at the remote target (and to accommodate the Fresnel effect.) The antennas for both the receiver/base unit and the remote camera/wireless transmitter unit can then be put into an operational position if needed (e.g., raised up.) The receiver/base unit and the remote camera/wireless transmitter unit can then be powered up (the respective power supply on/off switches may be placed into the "on" position.) The receiver/base unit and the remote camera/wireless transmitter unit then could be adjusted, if multi-channel capable, to be on the proper channel to establish the necessary wireless communication between the two units. By using the receiver/base unit's user interface (e.g., visual display and/or user input), the remote camera/wireless transmitter unit can be moved and the respective lens adjusted to focus in and on the remote target to result in an acceptable visual presentation of the remote target as provided by visual display.

In one possible embodiment, an armored shield (e.g., steel plate or other suitable protective material) anchored into the ground in an angled manner positioned near the remote camera/wireless transmitter unit and in between the shooter and the remote camera/wireless transmitter unit to deflect any stray round(s) from hitting the remote camera/wireless transmitter unit.

Step 102 can be generally repeated if additional remote camera/wireless transmitter units are to be deployed during the shooting session (e.g., to monitor/view additional remote targets.)

Once step 102 is substantially completed, the process 100 could proceed to step 104, setting up weather meters.

In step 104, setting up the weather meters, one or more weather meter/wireless transmitting units could be deployed in the field/area/shooting range where the shooting activity is to take place. Like the setup for the remote camera/wireless transmitting unit(s), the weather meter/wireless transmitting units and the receiver/base unit is taken to the location where a weather meter/wireless transmitting unit is desired. Again, the weather meter/wireless transmitting unit should be located away from the line-of-sight path between the shooter's position and the remote target(s). Once the weather meter/wireless transmitting unit is properly positioned (e.g., the weather meter placed in a pivoting vane atop a stand [e.g., a tripod] at the desired location with its respective transmitter nearby [e.g., the transmitter being supported by its own tripod if needed]), the weather meter and its respective transmitter are powered up. At this point, the communication link (e.g., smart radio frequency or RF communications, wired connection, or the like) between the weather meter and its respective wireless transmitter is checked for proper operation. Wireless communications between the weather meter's transmitter and the receiver/base unit can then be checked for proper operation (e.g., ensuring proper channel selection between the transmitter and receiver.)

Step 104 can be generally repeated if additional weather meters/wireless transmitter units are to be deployed during the shooting session (e.g., to monitor/view additional remote targets.) In this manner, a set of weather meter/wireless transmitter units can be deployed (e.g., offset in a safe distance from the line of sight/bullet path between remote target and shooter's position to avoid accidental shooting of the weather meter/wireless transmitter unit) in the area of the shooting activity to provide multiple points for real time weather (e.g., atmospheric, meteorological, etc.) conditions reporting and analysis. Some weather meter/wireless transmitter units can be on one side of the line of sight path and some weather meter/wireless transmitter units can be on the other side of the line of sight path (e.g., in shooting ranges/fields/areas when the wind has been known to blow in non-consistent, alternative directions throughout the day) to capture the atmospheric effect (e.g., wind) in blowing in either way across the line-of-sight path before the atmospheric effect has crossed the line-of-sight effect. The weather meter/wireless transmitter unit's proximity to the shooter's position can be given value and inputted into the ballistic calculator program of the computer so that each respective weather meter's transmitted data and the amount of time is received and processed by receiver/base unit, the data/data duration can be "weighted" based on that respective proximity. The closer the weather meter is to the shooter the more proportionally that weather meter's data will have upon the final calculation of firing solution.

In another alternative embodiment, the invention could further comprise a GPS capability (e.g., integrated into the receiver/base unit or be an independent hand-held unit) can be used with the setup of the invention to give location (mapping) values to the placement of the remote target, shooter's position and respective locations of the weather meter(s) so that the invention could real time calculate an-over all atmospheric condition map for the shooting range/site/area. In this manner for example, the computer could take the incoming data as measured by the set of weather meters of the wind burst to substantially create an animation graphic presentation on the video display so that a shooter could see a visual representation of wind burst (or continuous wind) and the wind's vector (e.g., speed/direction information) as the wind burst is moving through the shooting range and going past the shooting line of sight path. This information could be used in many ways by the shooter, primarily in controlling the timing for a shoot/no shoot decision for taking the shot at the moment when the wind could have the least amount of effect on shot's bullet trajectory/path or for correcting the aiming system to take into account the wind information. Once step 104 is generally completed, the process 100 can proceed to step 106, setting up receiver/base unit.

At step 106, setting up receiver/base unit, the powered up receiver/base unit is placed proximate to the shooter's location in a manner that the shooter can easily see and access the user interface without significantly moving from the shooters firing position. Once the receiver/base unit is put into place, the transmission reception can be checked of the remote video camera/wireless transmitter unit(s) and the weather meter/wireless transmitter unit(s) by cycling through the channels to see that the computer can access such data inflow from the various weather meters and target video signals. If data flow/video presentation is not established, the operator (e.g., the shooter) can take the necessary steps to correct such deficiencies by adjusting the channels on the wireless transmitters, receiver/base unit's receiver, adjusting the antenna positioning, adjusting the wireless transmitter height and the like. As step 106 is substantially completed, the process 100 can generally proceed to step 108, preparing the shot.

In step 108, preparing the shot, the shooter can input directly or recall from previously inputted and stored data about respective shooting information (e.g., target distance/elevation, bullet type, bullet ballistic coefficient, bullet drop, muzzle velocity, distance-to-target, and angle-to-target factors) into the ballistics program. The ballistics program can also take into account the real time atmospheric conditions data as provided by the weather meters. All of this data can be then continuously processed by the ballistics program into continuously updated firing shooting formulation presented on the visual display to the shooter.

The shooter then can suit up (e.g., get into a specialized shooting jacket with straps that helps hold the shooter's arms and torso into a firm and repeatable shooting position, load the firearm sling on the shooter's arm, load the firearm, move into the shooting position.) The shooter can aim the firearm at the target. As step 106 is substantially concluded, the process 100 could generally proceed to step 110, taking and analyzing the shot.

At step 110, taking and analyzing the shot, the shooter can glance at the presenting firing solution from the visual display and then adjust the aiming system of the firearm (e.g., dial in the firearm optics). The shooter then quickly glances at the latest atmospheric data/map, mentally makes any last minute corrects and begins to time the shot and concentrate on controlling her breathing pattern. When the shooter believes she has the best shot opportunity possible, she shoots the firearm/takes the shot.

After taking the shot, the shooter could glance over at the visual display to see the when the shot placed or did not place upon the target (the invention can be set to cycle through data presentation and visual target presentation or the shooter can reach over to the user interface and select which data, visual presentation or both she wants to see.) If the shooter is satisfied with the shot placement, the shooter can commence to fire another shot. If the shooter is not satisfied with the shot placement, then using the location of the shot impact on the target, the continuous updating fire solution from the invention, atmospheric condition information provided by the invention the shooter can make further adjustments to aiming system before taking another shot.

When the shooting session is over, the shooter moves out of her shooting position; takes off her shooting coat; and secures the firearm, ammunition and other firearms accoutrements. The shooter could retrieve shooting, atmospheric data, target visual presentations from the computer (using a USB thumb drive, smart radio frequency or RF communications capability, etc.) before powering down the receiver/base unit. The shooter can then retrieve (and power down) the weather meter/wireless transmitter unit(s), the remote camera/wireless transmitter unit(s) and other relevant items (e.g., actual target.) If embodiment allows (e.g., the receiver/base unit's storage box is large enough) the weather meter/transmitter unit(s), the remote camera/transmitter unit(s) can be stored within the box. If the shooter wishes to resume shooting activities with the invention, the process 100 could return to step 102.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the example.

What is claimed is:

1. A remote camera target observation system comprising:

(A) one or more remote camera/wireless transmitter units comprising a video camera connected to a first wireless transmitter that wirelessly transmits video signals from the video camera;

(B) one or more weather meter/wireless transmitter units comprising at least of a weather meter to continuously measure environmental conditions, the one or more weather meter/wireless transmitter units wirelessly transmits data signals of measured environmental conditions as made by the weather meter;

(C) a receiver/base unit that comprises a wireless receiver that connects to a computer, the computer connects to a user interface, the wireless receiver receives video signals from the one or more remote camera/wireless transmitter units and data signals of measured environmental conditions from the one or more weather meter/wireless transmitter units;

wherein one or more camera/wireless transmitter units transmits a video signal of an object located outdoors and remote from the receiver/base unit, the video signal is presented upon the user interface; the one or more weather meter/wireless transmitter units transmits data signals of the measured environmental conditions for the environmental conditions in an area where the object and the receiver base are both present, the computer processes the data signals of the measured environmental conditions along with other data to present upon the user interface a firing solution used to shoot the object.

2. The remote camera target observation system of claim 1 wherein the weather meter is attached to a vane pivotal mounting, the vane pivotal mounting is movably attached to a top of a stand that locates the weather meter remote from the ground; the weather meter communicates with a second wireless transmitter to transmit to the receiver base unit the data signals of measured environmental conditions as measured by the weather meter.

3. The remote camera target observation system of claim 2 wherein the second wireless transmitter is proximate to but not in physical contact with the weather meter.

4. The remote camera target observation system of claim 3 wherein the first, the second wireless transmitter or both are held away from the ground by a respective stand.

5. The remote camera target observation system of claim 1 wherein the environmental conditions are continuously measured by the one or more weather meter/transmitting units to be continuously received and processed by the computer to continuously update the firing solution.

6. The remote camera target observation system of claim 1 wherein the receiver/base unit further comprises of a hinged lid container supporting the wireless receiver, computer, user interface, a power supply for the receiver/base unit and providing storage space for one or more remote camera/wireless transmitter units and one or more weather meter/wireless transmitter units.

7. The remote camera target observation system of claim 1 wherein the receiver/base unit processes an input of one or more weighted values assigned to the one or more transmitted data signals of the measured environmental conditions as transmitted by a respective weather meter/wireless transmitter unit of the one or more weather meter/wireless transmitter units, the one or more weighted values assignment is based upon a distance of the respective weather meter/wireless transmitter unit to the receiver/base unit.

8. The remote camera target observation system of claim 1 wherein the receiver/base unit processes an input of one or more weighted values assigned to the one or more transmitted data signals of the measured environmental conditions as transmitted by a respective weather meter/wireless transmitter unit of the one or more weather meter/wireless transmitter units, the one or more weighted values assignment is based upon a distance of the respective weather meter/wireless transmitter unit to the target.

9. A remote camera target observation system of claim 1 wherein weighted values are used to proportion the effect that the respective weather meter/wireless transmitter unit's transmitted data signals of the measured environmental condition shall have on the calculation of the firing solution.

10. A method of operating a remote camera target observation system comprising the following steps, but not necessarily in the order shown:

(A) a remote camera target observation system comprising of one or more remote camera/transmitters for wireless transmission of video pictures of an object remote from a shooter, one or more weather meter/wireless transmitter units that measure environmental conditions in an area between the shooter and the object, a receiver/base unit that is located proximate to the shooter and that receives wireless signals from both the one or more remote camera/transmitter units and the one or more weather meter/wireless transmitter units, the receiver/base unit capable of further processing the received wireless signals into a firing solution presented though a user interface;

(B) processing the environmental conditions data collected and transmitted by the one or more weather meter/wireless transmitter units along with other data into a firing solution used to shoot the target; and (C) presenting upon the user interface a visual image of the object along with the firing solution.

11. The process of claim 10 further comprising a step of using the firing solution to alter the settings of an aiming system of a firearm.

12. The process of claim 10 further comprising a step of continuously updating the firing solution using continuous real time reporting of the environmental conditions of the area as reported by the one or more weather meter/transmitter units to the receiver/base unit.

13. The process of claim 10 further comprising a step of assigning weighted values to a respective weather meter/wireless transmitter units of the one or more weather meter/ wireless transmitter units based on the respective weather meter/wireless transmitter unit's distance to the shooter.

14. The process of claim 13 wherein the step of assigning weighted values further comprises a step of proportionally increasing or decreasing the effect of the collected and transmitted environmental conditions data from the respective weather meter/wireless transmitter unit on the firing solution calculation the closer the weather meter/wireless transmitter units is in proximity to the shooter.

15. The process of claim 10 further comprising a step of assigning weighted values to a respective weather meter/wireless transmitter units of the one or more weather meter/wireless transmitter units based on the respective weather meter/wireless transmitter unit's proximity to the object.

16. The process of claim 15 wherein the step of assigning weighted values further comprises a step of proportionally decreasing or increasing the effect of environmental conditions data transmitted from the respective weather meter/wireless transmitter unit on the firing solution calculation based on the weighted values assigned to the respective weather meter/wireless transmitter unit.

17. A combination of a remote camera target observation system and a firearm comprising:

(A) One or more camera/wireless transmitter units comprising a video camera connected to a first wireless transmitter that can wirelessly transmits video signals from the video camera taken of an object;

(B) one or more weather meter/wireless transmitter units comprising a weather meter that wirelessly transmits data signals on environmental conditions as measured by the weather meter;

(C) a receiver/base unit that comprises a wireless receiver connected to a computer that is further connected to a user interface with a visual display, the wireless receiver receives the video signals from the one or more camera/wireless transmitter units and environmental conditions data signals from the one or more weather meter/wireless transmitter units;

(D) a firearm having an aiming system;

wherein the one or more camera/wireless transmitter units transmits the video signals of the object that is located outdoors and remote from the firearm, the video signals are presented upon the visual display; the one or more weather meter/wireless transmitter units transmits environmental condition data signals for the environmental conditions in an area where the object and the receiver/base are both present, the computer processes the environmental condition data signals along with other data to present a firing solution through the user interface that is used to adjust the aiming system of a firearm to properly aim the firearm at the object.

18. The combination of claim 17 wherein a second wireless transmitter relays the environmental conditions data signals as measured by the weather meter to the receiver base unit.

19. The combination of claim 18 wherein the second wireless transmitter is proximate to but not in physical contact with the weather meter.

20. The combination of claim 17 wherein the environmental conditions are live-time recorded by the one or more weather meter/transmitting units to be continuously received and processed by the computer to continuously update the firing solution.

* * * * *